United States Patent [19]

Oppolzer

[11] 4,034,582

[45] July 12, 1977

[54] STEERING COMPENSATION MEANS FOR GUIDE BARS UTILIZED IN WARP KNITTING MACHINES HAVING TWO NEEDLE BEDS

[75] Inventor: Johann Oppolzer, Urberach, Hessen, Germany

[73] Assignee: Karl Mayer Textilmaschinenfabrik GmbH, Obertshausen, Germany

[21] Appl. No.: 705,986

[22] Filed: July 16, 1976

[30] Foreign Application Priority Data

Aug. 23, 1975 Germany ..... 2537666

[51] Int. Cl.[2] ..... D04B 23/00

[52] U.S. Cl. ..... 66/207

[58] Field of Search ..... 66/207, 154

[56] References Cited

U.S. PATENT DOCUMENTS

| | | | |
|---|---|---|---|
| 2,229,928 | 1/1941 | Morrison | 66/207 |
| 2,625,023 | 1/1953 | Bellini | 66/207 |
| 2,775,881 | 1/1957 | Held | 66/207 |

*Primary Examiner*—Ronald Feldbaum
*Attorney, Agent, or Firm*—Behr & Woodbridge

[57] ABSTRACT

The guide bars of a warp knitting machine include a compensation means which allows the guides on the guide bar to pass more precisely between the gaps in the needles of an associated needle bed. The compensation means is located between a pattern wheel follower and a push rod which is rotatably attached at one end to the guide bar. An adjustable lever is attached at one end to the push rod and at the other end to a rotatable pin. The rotatable pin is associated with a housing which contains an eccentric roller cam. The eccentric roller cam is directly connected to the rotatable pin and is displaceable in direct response to the rotation of the rotatable pin. A short rod having an angled face is adapted to make contact with the eccentric roller cam. The other end of the rod is pivotally connected to one end of the push rod by a ball joint. When the guide bar is displaced from one needle bed to another the push rod and accordingly, the lever follow that motion. The motion of the lever rotates the rotatable pin which in turn displaces the roller cam. The displacement of the roller cam forces the push rod forward thereby compensating for the assymetric movement of the guide bar.

7 Claims, 2 Drawing Figures

STEERING COMPENSATION MEANS FOR GUIDE BARS UTILIZED IN WARP KNITTING MACHINES HAVING TWO NEEDLE BEDS

BACKGROUND OF THE INVENTION

1. Field of the Invention

This invention relates to an apparatus and method for compensating for the swinging movement of guide bars on a warp knitting machine.

2. Description of the Prior Art

A very useful description of the state of the warp knitting art may be found in a book entitled "Warp Knitting Technology" by D. F. Paling, Columbine Press Ltd., first published in 1,952 and reprinted in 1970. That book is especially useful in understanding conventional warp knitting features such as the guide bar swinging mechanism.

It is well known in the warp knitting art that it is difficult to utilize an even number of guide bars where it is desirable to knit across two sets of needle bars. In general central bars cannot be symmetrically oriented with respect to the needle bars. The difficult resides in the fact that if the guide bars swing through an arc to come into operating association with a second needle bed, then it is very likely that the guides in the guide bar will not be lined up parallel with the needles and other elements of the needle bed. This slight angular displacement can be very undesirable where the gaps between the needles are small. For the foregoing reasons one generally could not operate with an even number of guide bars activated by push rods unless one used the so-called "Riegel" drive which is known to cause high friction and to operate with substantial undesirable torque. Even using this method, the total number of guide bars is limited. Accordingly, an apparatus and method was needed which would compensate for the undesirable angular displacement of guide bars so that an even number of guide bars could be used on a warp knitting machine.

SUMMARY OF THE INVENTION

Briefly described, the purpose of the invention is to provide for an even number of guide bars on a warp knitting machine, for example, by centrally locating guide bars working together outside of the axis of symmetry. The guide bars are driven back and fourth by a push rod driven means which in turn is controlled by the motion of a pattern wheel and cam follower arrangement. The push rod is given an additional shogging motion which is controlled in relation to the swinging motion of the guide bar. By means of this novel, additional, shog of push rod, it is now possible to steer the guide bars during the swinging motion, in a direction of their ordinary displacement, so that despite the asymmetric orientation thereof, the guide bars are enabled to pass precisely between the gap in the needles of the needle bar.

It is also within the purview of the present invention to equip the guide bars working directly with the needle bars, in a similar manner so that these may both also work together with the two needle bars.

In general the invention comprises a warp knitting machine wherein one set of guides works with a first needle bar and a second set of guides works with a second needle bar and a third set of guides which lies between the aforementioned first and second guides works alternately with the first and then with the second needle bars. There is thus provided an uneven number of guides, i.e. guide bars, wherein the guide bar is located precisely between the first and second set of guide bars since only then is it possible to orient the guide bars in such a manner that the guides of the middle guide bar pass precisely between all of the gaps between the needles and the respective needle bars.

The movement of the swinging guide bar as it moves from one needle bed to a second needle bed is compensated for by a compensating steering means which shogs the bar outward during its angular displacement. The compensating means comprises a lever which is operatively connected to an eccentric cam through a rotatable pin which in turn impinges upon a rod and ball joint connected to the push rod. Accordingly, the angular displacement of the push rod and the lever connected thereto is translated into a forward or backward shogging motion imparted to the push rod during its angular displacement. These and other features of the present invention will be more fully understood with reference to the following drawings and detailed description of the invention.

DETAILED DESCRIPTION OF THE INVENTION

During the course of this description like numbers will be used to identify like elements according to the two different figures illustrated herein.

Figure 1:
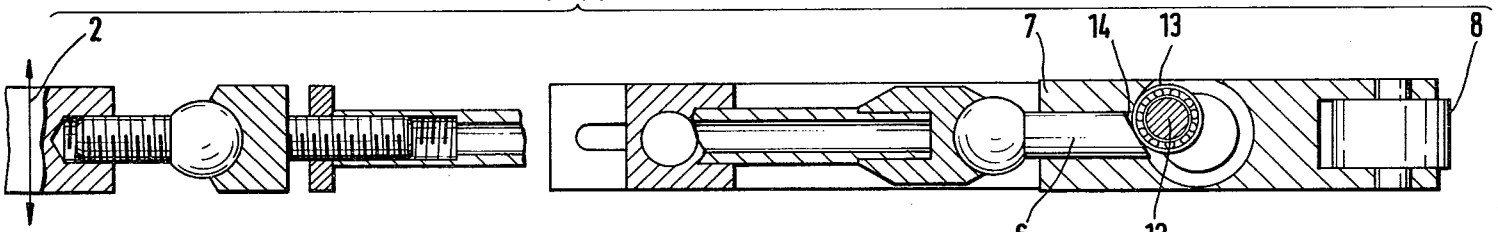
FIG. 1 is a bottom cross-sectional view of the apparatus of the present invention according to the preferred embodiment.
Figure 2:
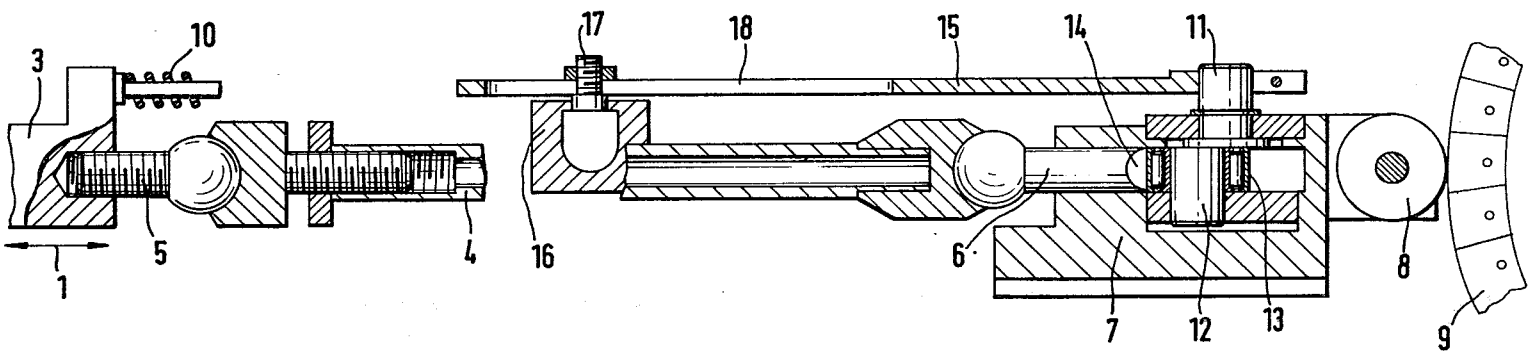
FIG. 2 is a side cross-sectional view of the apparatus illustrated in FIG. 1.

The preferred embodiment of the present invention is illustrated in FIGS. 1 and 2. According to FIGS. 1 and 2, the guide bar 3 is adapted to swing back and forth in the direction of arrow 2 as illustrated in FIG. 1 or to shog back and forth in the direction of arrow 1 as illustrated in FIG. 2. A pin and ball pivot combination 5 rotatably attaches the guide bar 3 to the push rod 4. The other end of push rod 4 is pivotally connected to another pin and ball joint connector 6. Elements 6, 7, and 11 through 18 comprise a steering compensation device to adjust for the asymmetric swinging motion of the guide bar 3. A pattern chain wheel cam 9 and a cam follower 8 comprise a conventional pushing means for moving the push rod 4 and the associated guide bar 3 back and forth in the direction of arrow 1.

An additional shog is imparted to the guide bar 3 in the direction of arrow 1 in direct proportion to displacement of lever 18. One end of lever 18 is connected through pin 17 and split collar 16 to push rod 4. The effective point of contact of the lever 18 with the push rod 4 can be adjusted by sliding pin 17 along a groove in lever 18 and then locking the pin 17 with respect to the groove by means of an appropriate nut or the like. The other end of lever 18 is rigidly connected to a rotatable pin 11. Accordingly, any angular displacement of the lever 18 in the direction of the swinging motion 2 will cause pin 11 to rotate. Rotatable pin 11 is mounted on top of housing 7 and is connected via a plate to an eccentrically mounted pin 12. A freely rotatable roller bearing 13 surrounds the pin 12. The pin 12 and the roller bearing 13 comprise an eccentrically mounted cam combination when viewed in conjunction with rotatable pin 11. The ball end of rod and ball combination 6 is pivotally connected to one end of push rod 4 in the manner previously described. The other end of the ball and rod combination 6 comprises an angled flat surface 14 which is adapted to make line or point contact with the roller bearing 13.

In operation when the guide bar 3 is in a direction roughly parallel and straight ahead of the housing 7, then there is no compensation movement imparted to the guide bar 3 by the compensation mechanism. However, when the guide bar 3 swings in the direction indicated by arrow 2 then the compensation steering mechanism gives the guide bar an additional shog to compensate for the asymmetric motion thereby making it easier for the guides to fit more precisely between the needles of the needle bar. Specifically, when the guide bar 3 is angularly displaced by a conventional swinging mechanism such as that disclosed in "Warp Technology", then since the push rod 4 is connected to the guide bar 3 it also follows the movement in the direction of arrow 2. A spring device 10 maintains the guide bar 3 in compressed contact with the rest of the elements previously described. The angular displacement of the push rod 4 in the direction of swinging motion 2 is detected by lever 18 and transmitted to pin 11 which is caused to rotate with the lever 18. Rotatable pin 11 in turn is directly connected through a plate to the eccentric cam which comprises eccentric pin 12 and roller bearing 13. The movement of the eccentric cam combination 12 and 13 against angled face 14 causes the ball and rod combination 6 to shog either outwardly or inwardly, depending upon the direction in which the eccentric cam is caused to rotate. For example, if the guide bar 3 were located near one needle bed and were caused to swing in the direction 2 towards a needle bed further removed, then the compensating steering device would probably give the guide bar 3 an additional outward shog in order to compensate for its typically asymmetrical movement. On the other hand, if the guide bar 3 were travelling from a further removed needle bar towards a closer needle bar, then the guide bar 3 would probably shog in the opposite direction. Obviously the amount of shog and the direction of shog will depend upon the location of the guide bar 3 relative to the needle bars.

While the invention has been described with reference to a preferred embodiment thereof, it will be appreciated that several modifications of the invention are possible. For example, while the lever 18 has been shown as being connected to the push rod 4, it is possible of course, that it might be in some manner connected directly to the guide bar 3. Similarly, rod and ball joint connections 5 and 6 could be replaced by other types of hinges or swiveling mechanisms. The surface 14 has been described as being angled with respect to the axially direction of rod and ball combination 6 but it will be appreciated by those of ordinary skill in the art that angling may not be necessary or that the degree of angling used will depend very much upon the results desired from the compensation steering means. It is further within the scope of the present invention that the compensation could be achieved via the swinging guide bars or the suspending means therefor; however, under such circumstances, additional connecting members would be required.

While the invention has been completely described with reference to a preferred embodiment thereof it will be appreciated by those of ordinary skill in the art that modifications in the parts and the arrangements of the parts can be made without departing from the spirit and scope of the invention.

I claim:

1. A warp knitting machine guide bar compensation apparatus comprising:

a push rod connectable to a guide bar on a warp knitting machine;

a pushing means for imparting a pushing motion to said push rod; and, a compensation means located between said pushing means and said push rod for modifying the pushing motion of said pushing means in response to the angular displacement of said guide bar, said compensation means including:

a linkage means connected to said push rod; and, an eccentric means connected to said linkage means and adapted to influence the movement of said push rod.

2. The apparatus of claim 1 wherein:

said linkage means comprises a lever connected at one end of said push rod and at the other end to a rotatable pin; and, said eccentric means comprises an eccentric cam means operably displaceable in response to the rotation of said rotatable pin and, a rod means rotatably connected at one end to said push rod and having a surface at the other end thereof adapted to come into contact with said eccentric cam means.

3. The apparatus of claim 2 wherein said pushing means comprises:

a pattern wheel chain cam; and, a cam follower attached to said compensation means and adapted to make contact with said pattern wheel chain cam.

4. The apparatus of claim 3 wherein said rod means surface is angled with respect to a line perpendicular to the length of said rod means and to a line parallel to the length of said rod means.

5. The apparatus of claim 4 wherein said rod means and said eccentric cam are located in a housing.

6. The apparatus of claim 5 wherein said lever is connected to said push rod by an adjustable slider means.

7. A method of compensating for the movement of the guide bars of a warp knitting machine comprising the steps of:

angularly displacing said guide bar from an initial position;

following the angular displacement of said guide bar with a linkage mechanism; and, displacing said guide bar in response to the following movement of said linkage mechanism.

* * * * *